US007364516B2

(12) United States Patent
Kim

(10) Patent No.: US 7,364,516 B2
(45) Date of Patent: Apr. 29, 2008

(54) GOLF EXERCISING METHOD

(75) Inventor: Yong Woo Kim, Rochester, NY (US)

(73) Assignee: Kellion Corporation, Rochester, NY (US)

( * ) Notice: Subject to any disclaimer, the term of this patent is extended or adjusted under 35 U.S.C. 154(b) by 0 days.

(21) Appl. No.: 11/464,863

(22) Filed: Aug. 16, 2006

(65) Prior Publication Data

US 2007/0004526 A1 Jan. 4, 2007

Related U.S. Application Data

(62) Division of application No. 10/075,204, filed on Feb. 14, 2002, now Pat. No. 7,153,245.

(51) Int. Cl.
*A63B 69/36* (2006.01)
*A63B 21/00* (2006.01)

(52) U.S. Cl. ..... 473/409; 473/229; 482/121; 482/122

(58) Field of Classification Search ..... 473/207, 473/213–229, 258; 482/109, 121–130, 904; 434/247, 248, 252
See application file for complete search history.

(56) References Cited

U.S. PATENT DOCUMENTS

| | | | | |
|---|---|---|---|---|
| 5,072,934 | A * | 12/1991 | Blanes | 482/94 |
| 5,158,299 | A * | 10/1992 | Otter | 473/229 |
| 5,423,730 | A * | 6/1995 | Hirsch | 482/92 |
| 5,524,893 | A * | 6/1996 | McGinnis et al. | 473/229 |
| 6,558,302 | B2 * | 5/2003 | Cluff | 482/129 |
| 6,648,780 | B1 * | 11/2003 | Boldin | 473/461 |
| 7,048,638 | B2 * | 5/2006 | Novotny | 473/219 |
| 7,153,245 | B2 * | 12/2006 | Kim | 482/121 |

* cited by examiner

*Primary Examiner*—Nini F. Legesse
(74) *Attorney, Agent, or Firm*—Brown & Michaels, PC

(57) ABSTRACT

A golf swing exerciser uses two lengths of resistance cords or tension elements connected to an exercising handle so that one of the cords extends to an upper resistance region on a back swing side of the exerciser and the other resistance cord extends between upper and lower resistance regions on a back swing side of the exerciser. The cord from the upper resistance region resists downward movement of an exercising handle from a back swing region, and the cord extending between the upper and lower resistance regions resists lateral movement of the handle into a hitting region. The combined resistance of both cords significantly increases as the handle moves into the hitting region.

18 Claims, 10 Drawing Sheets

GOLF EXERCISING METHOD

REFERENCE TO RELATED APPLICATIONS

This is a divisional patent application of application Ser. No. 10/075,204, filed 14 Feb. 2002, entitled GOLF EXERCISER now U.S. Pat. No. 7,153,245. The aforementioned application is hereby incorporated by reference.

BACKGROUND

The prior art has generally recognized the benefits of strengthening muscles needed for swinging sports implements, and specifically for golf club swinging muscles, the prior art contains several suggestions. All of these are problematic for various reasons and none has become widely used.

Most of the patents suggesting golf swing exercisers apply a swing resistance that remains in a fixed location during the swing. This fails to orient the resistance in an effective direction throughout the swing, as can be seen from U.S. Pat. Nos. 4,229,002; 4,135,714; 4,253,663; 3,462,156 and 3,966,203.

A few other patents, including U.S. Pat. Nos. 5,050,874 and 5,284,464 suggest a swing resistance mounted on a central pivot so that the resistance follows a circular arc as the swing proceeds. This also is less than optimum, because a golf swing differs significantly from a circular arc.

Another U.S. Pat. No. 5,242,344 suggests a more complex movement of a swing resistance, but this requires a cumbersome and complex machine.

My invention aims at a swing exerciser applicable and especially suitable for exercising muscles used in a golf swing by applying a resistance in an amount and a direction that are effectively matched to the force and direction requirements of the swing. My invention also keeps the necessary equipment simple so that swing exercising can be accomplished in an especially effective way without undue expense.

SUMMARY

My swing exerciser is especially appropriate for a golf swing, since a golf swing extends through many feet of a complex curve as it proceeds from a back swing region to a hitting region. My invention keeps a resistance properly oriented to effectively resist advance of a golf handle through different regions of a golf swing so that a golf exerciser can feel comfortable and natural in a swing exercise.

Since most of the muscle force applied in hitting a golf ball is concentrated in the swing's approach to a hitting region, my invention applies significantly increased resistance in this region of the swing. This makes the muscles work especially hard as the golf handle approaches the hitting region, which effectively develops the muscle strength necessary for applying power to the golf swing.

My swing exerciser accomplishes these benefits with a resistance system that uses two lengths of cords or tension elements connected to an exercising handle to apply elastically deformable resistance to movement of the handle through a golf swing. Both of the resistance or tension elements are arranged on a back swing side of the exerciser to apply resistance to movement of the handle downward from the back swing region and forward into the hitting region. A first one of the tension elements is deployed from an upper tension region above the exerciser's shoulder to resist downward movement of the handle, and a second one of the tension elements extends from the handle to both the upper tension region and a lower tension region to resist movement of the handle forward into the hitting region. The combined resistances of the first and second elements are preferably greatest as the handle enters the hitting region.

DRAWINGS

Figure 5A:
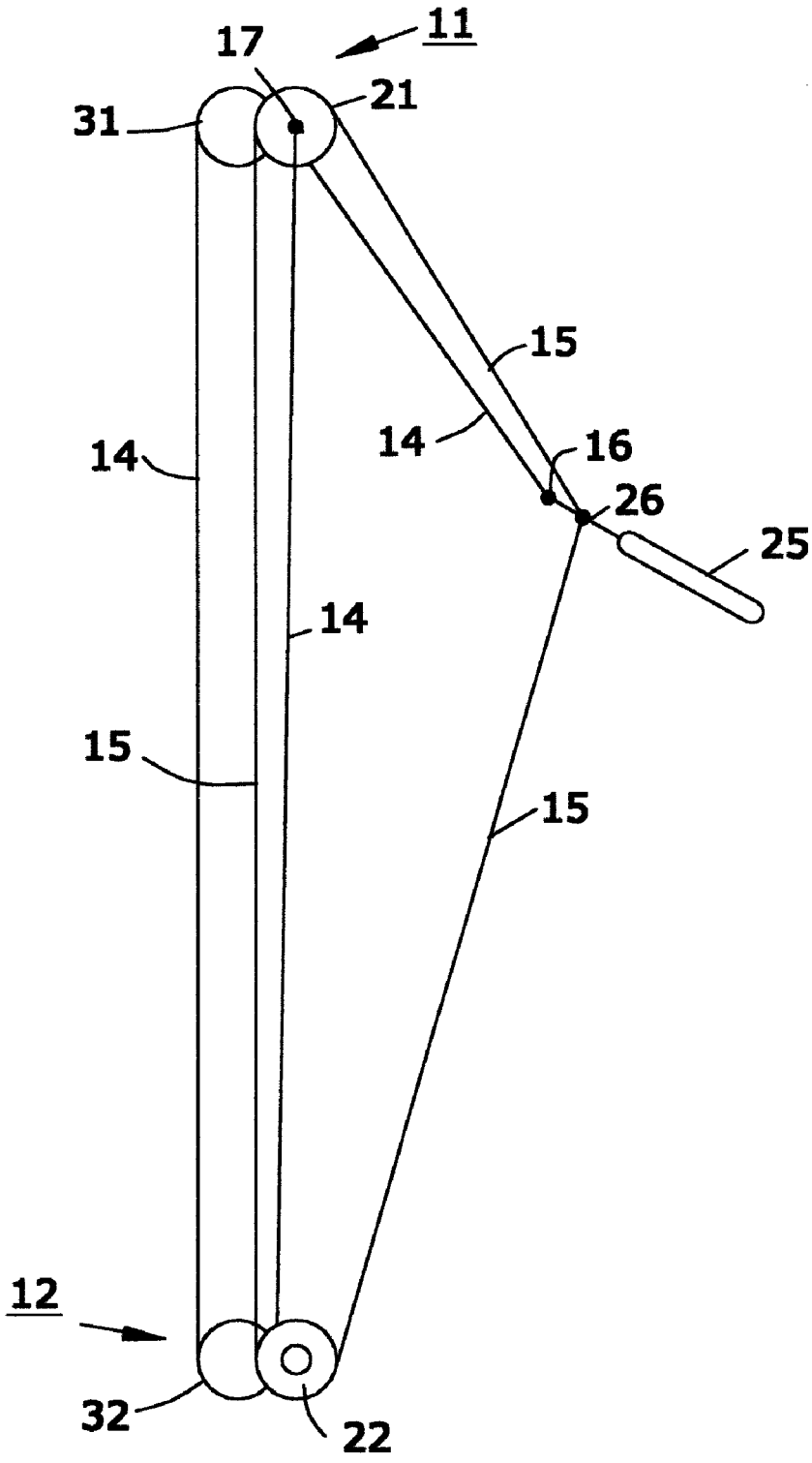

FIGS. 5A and B and FIGS. 6-9 schematically show several preferred embodiments of the inventive exerciser using different arrangements of tension cords and elastically deformable elements.

DETAILED DESCRIPTION

Figure 1:
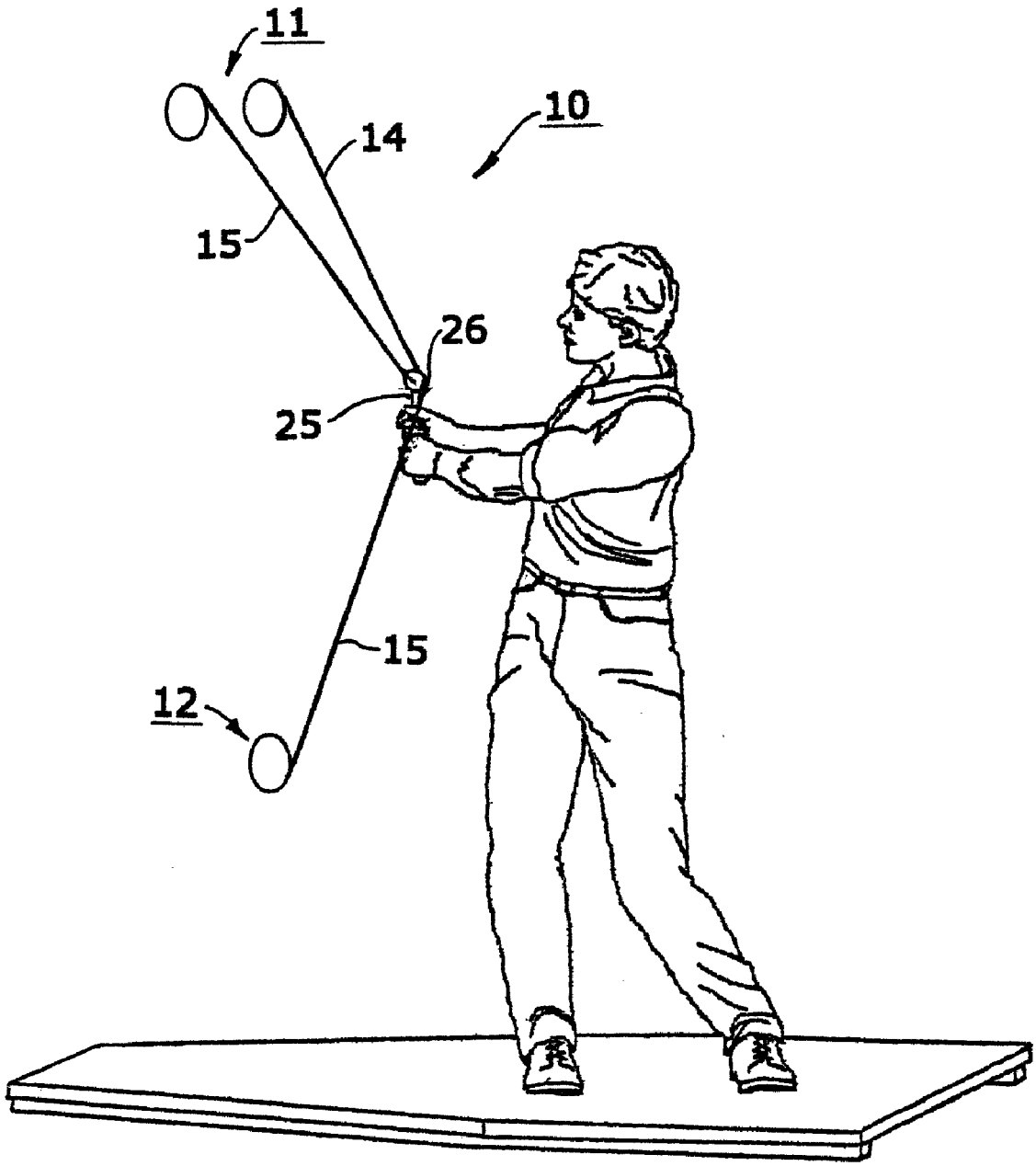
FIGS. 1 and 2 show a partially schematic preferred embodiment of the inventive golf exerciser used in the back swing position in FIG. 1 and in the hitting region in FIG. 2.
Figure 2:
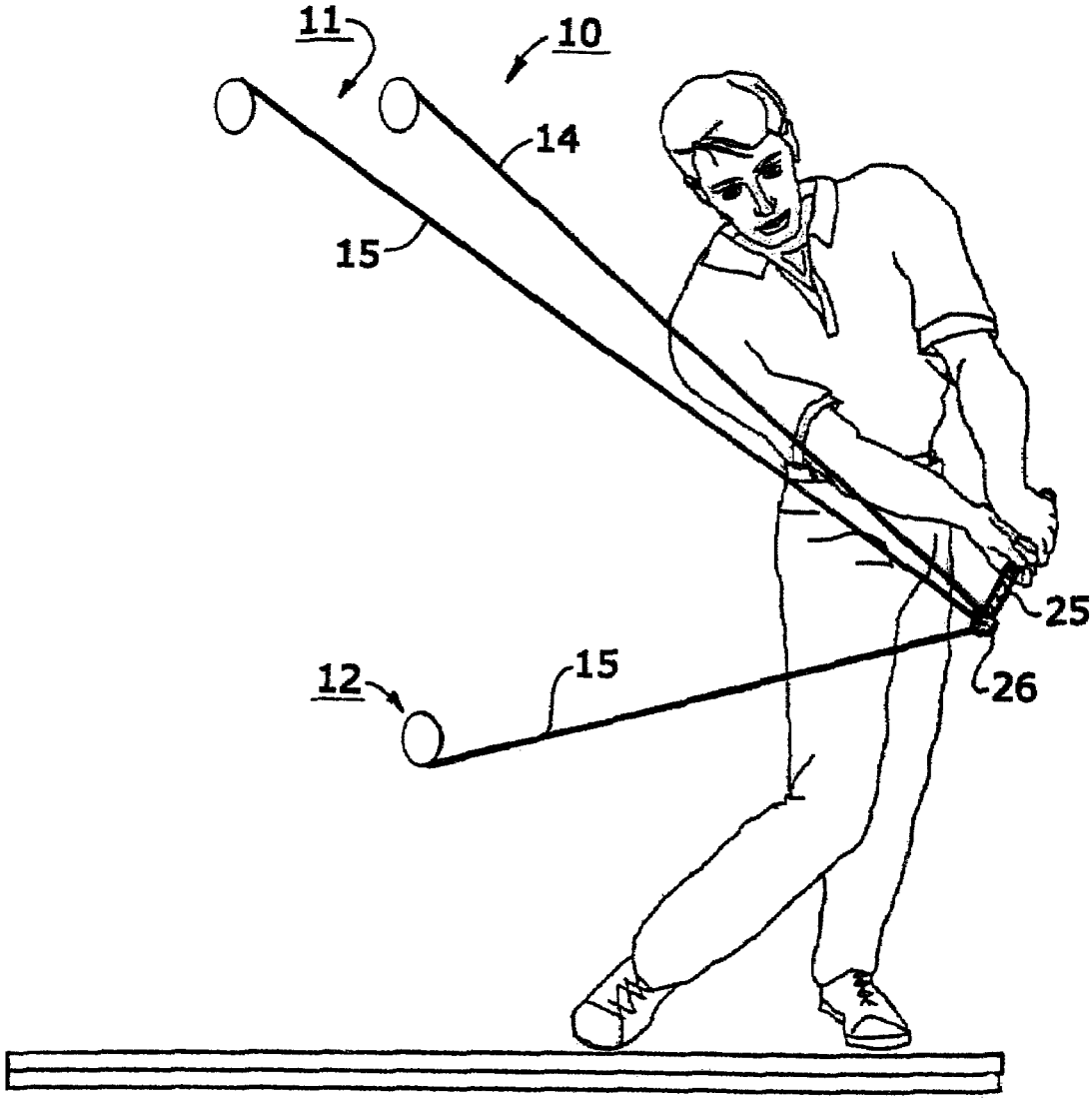

As shown schematically in FIGS. 1 and 2, a golf exerciser wields a handle 25 connected to cords or tension elements that effectively resist movement of handle 25 through the complex curve of a golf swing for exercise purposes. The cords, tension elements, and resistance system are explained more fully below, and the purpose of the illustrations of FIGS. 1 and 2 is to show the positional deployment of the resistance system relative to the golf swing exerciser.

The inventive golf swing resistance system 10 is arranged on a back swing side of the exerciser and includes an upper resistance region 11 and a lower resistance region 12. One tension element 14 extends from upper resistance region 11 to handle 25, and another tension element 15 extends between upper resistance region 11 and lower resistance region 12 while passing over or through either a pulley or low friction element 26 on handle 25. Resistance cord 14 primarily resists downward movement of handle 25 from a back swing region shown in FIG. 1 to a lower hitting region shown in FIG. 2. Resistance element 14 can also add some increasing resistance as handle 25 moves through the hitting region shown in FIG. 2. Resistance cord 15 primarily resists movement of handle 25 away from upper and lower resistance regions 11 and 12 and into the hitting region shown in FIG. 2. Cord 15 offers relatively little resistance to downward movement of handle 25 from the back swing region of FIG. 1.

The combined resistance of cords 14 and 15 is greatest as handle 25 approaches and passes through the hitting region of FIG. 2 so as to require maximum muscle force by the exerciser in moving handle 25 through the hitting region. The combined effect of resistance elements 14 and 15 is predetermined to allow the exerciser to swing handle 25 realistically through the curve of a golf swing and to provide appropriate resistance along each increment of the swing so the exerciser can strengthen the muscles used in a golf swing. Although each of the tension elements 14 and 15 provides some resistance to the golf swing, the combined effect of both elements 14 and 15 is necessary to optimize resistance forces to be overcome during swinging exercise. Downward resistance is necessary to develop muscles that drive a golf club head downward into the hitting region, and lateral resistance is necessary to strengthen muscles that are needed to drive a golf club head forward through the hitting region.

Figure 3:
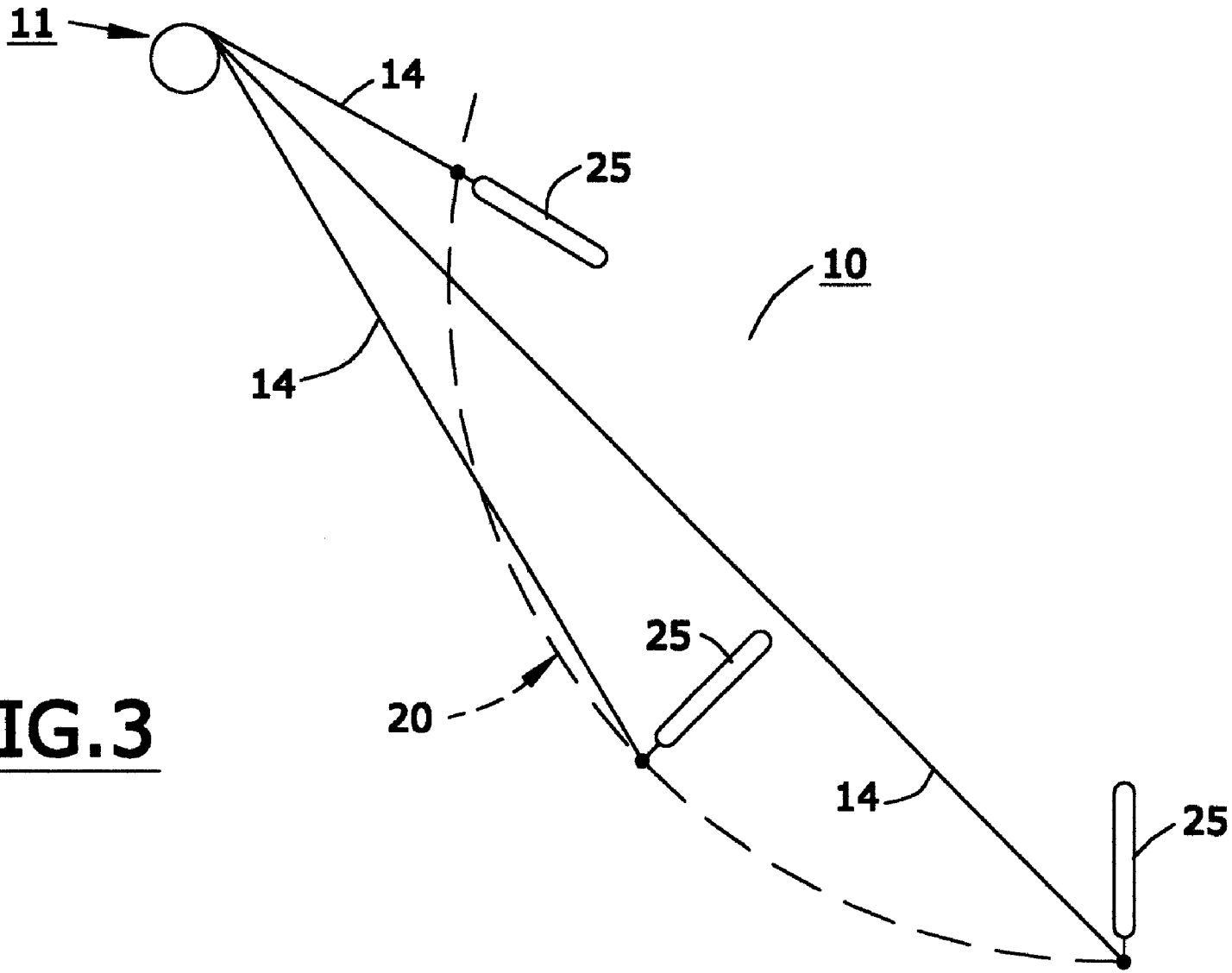
FIGS. 3 and 4 are schematic diagrams of approximate forces and directions involved in the inventive exerciser as represented by resistance cord lines extending from a golf handle to an upper resistance region in FIG. 3 and to upper and lower resistance regions in FIG. 4.

FIG. 3 schematically shows the resistance function of tension element 14 as handle 25 moves through the broken line curve 20 of a golf swing. Cord 14 is shortest as it extends from upper resistance region 11 to handle 25 at the upper back swing region, and as handle 25 moves downward along curve 20 to a mid swing region, tension cord 14 elongates considerably to provide resistance to downward handle movement. As handle 25 moves on to the hitting region at the lower end of swing curve 20, tension element 14 elongates further.

Figure 4:
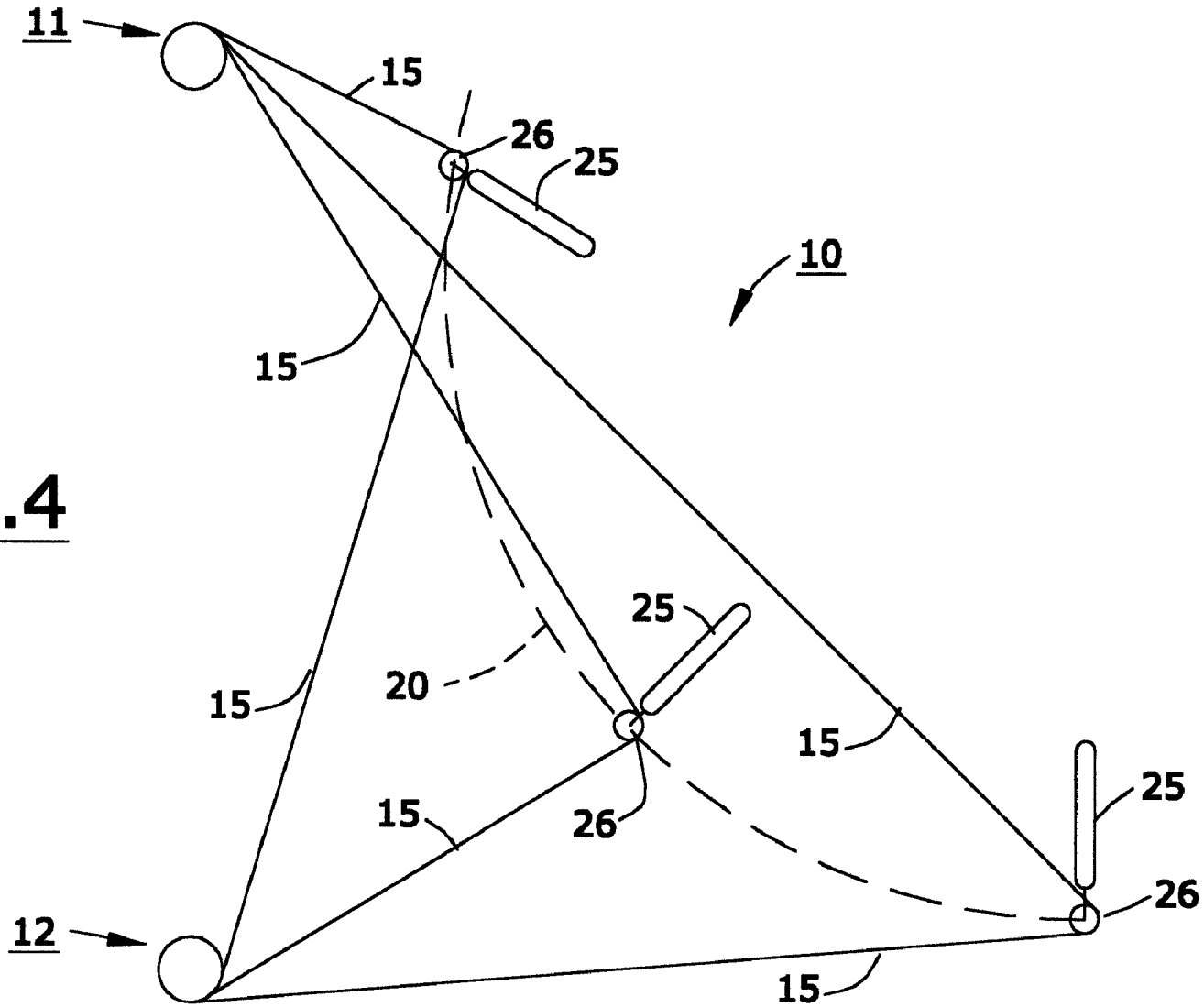

Tension element 15, as schematically shown in FIG. 4, extends between upper resistance region 11 and lower resistance region 12 and over a pulley or low friction element 26 on handle 25. As handle 25 moves from the back swing position to the mid swing position, cord 15 rolls over pulley 26 and is elongated only slightly, to provide little resistance to such downward movement. As handle 25 advances into the hitting region shown at the lower end of swing curve 20, tension element 15 elongates considerably because of the movement of handle 25 away from upper and lower resistance regions 11 and 12. This allows tension element 15 to provide strong resistance to the movement of handle 25 through the hitting region so as to require strengthening of golf hitting muscles from driving handle 25 through the hitting region.

The combined effect of resistance cords 14 and 15 provides resistance to handle movement downward from the back swing region and then gradually and significantly increased resistance to movement of handle 25 into the hitting region. Repeatedly swinging handle 25 through swing curve 20 against the resistances provided by cords 14 and 15 strengthens an exerciser's golf hitting muscles and improves golf hitting ability.

Figure 5B:
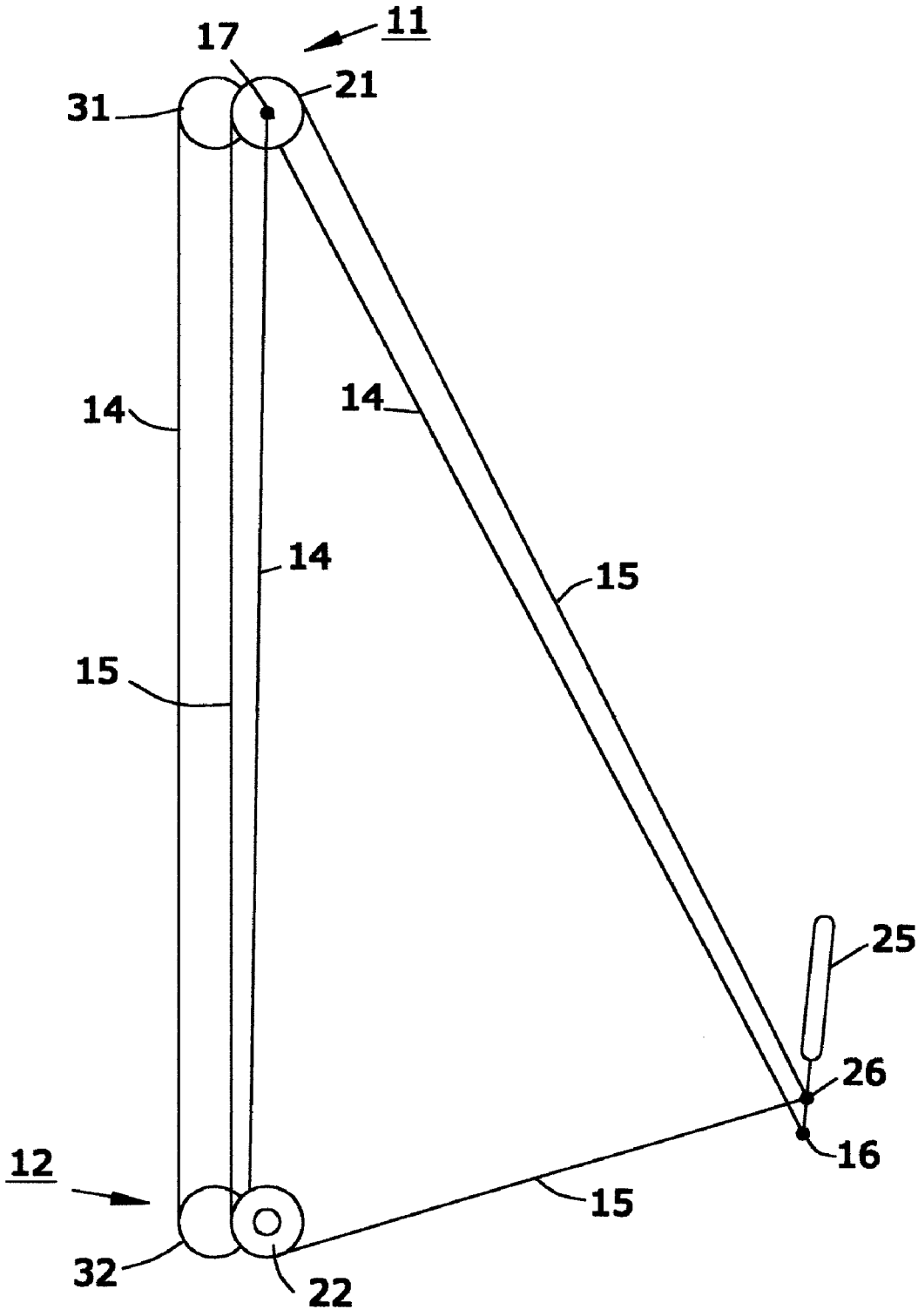

FIGS. 5A and B show one preferred embodiment arranged to accomplish the functions described above with handle 25 in the back swing position in FIG. 5A and in the hitting position in FIG. 5B. Upper resistance region 11 mounts two fixed pulleys 21 and 31, and lower resistance region 12 mounts another pair of fixed pulleys 22 and 32. Tension element 14 extends from a fixed connection 16 on handle 25 over pulleys 31 and 32 to an opposite end 17 fixed in upper tension region 11 on pulley 21, for example. Cord 14 is formed of an elastomerically stretchable material such as a bungie cord or tube that can stretch, resist stretching, and can retract from a stretched position. As handle 25 moves from the back swing position of FIG. 5A to the hitting position of FIG. 5B, cord or tube 14 elongates as it rolls over pulleys 31 and 32 to provide resistance to movement of handle 25.

Tension cord 15 is formed as a continuous loop reeved over fixed pulleys 21 and 22, and over pulley 26, which is moveable with handle 25. Cord 15 is also formed of an elastomeric strand or tube that stretches resistantly when handle 25 moves from its back swing to its hitting positions. The combined resistance of cords 14 and 15 is greatest as handle 25 moves through the hitting region of FIG. 5B.

Figure 6:
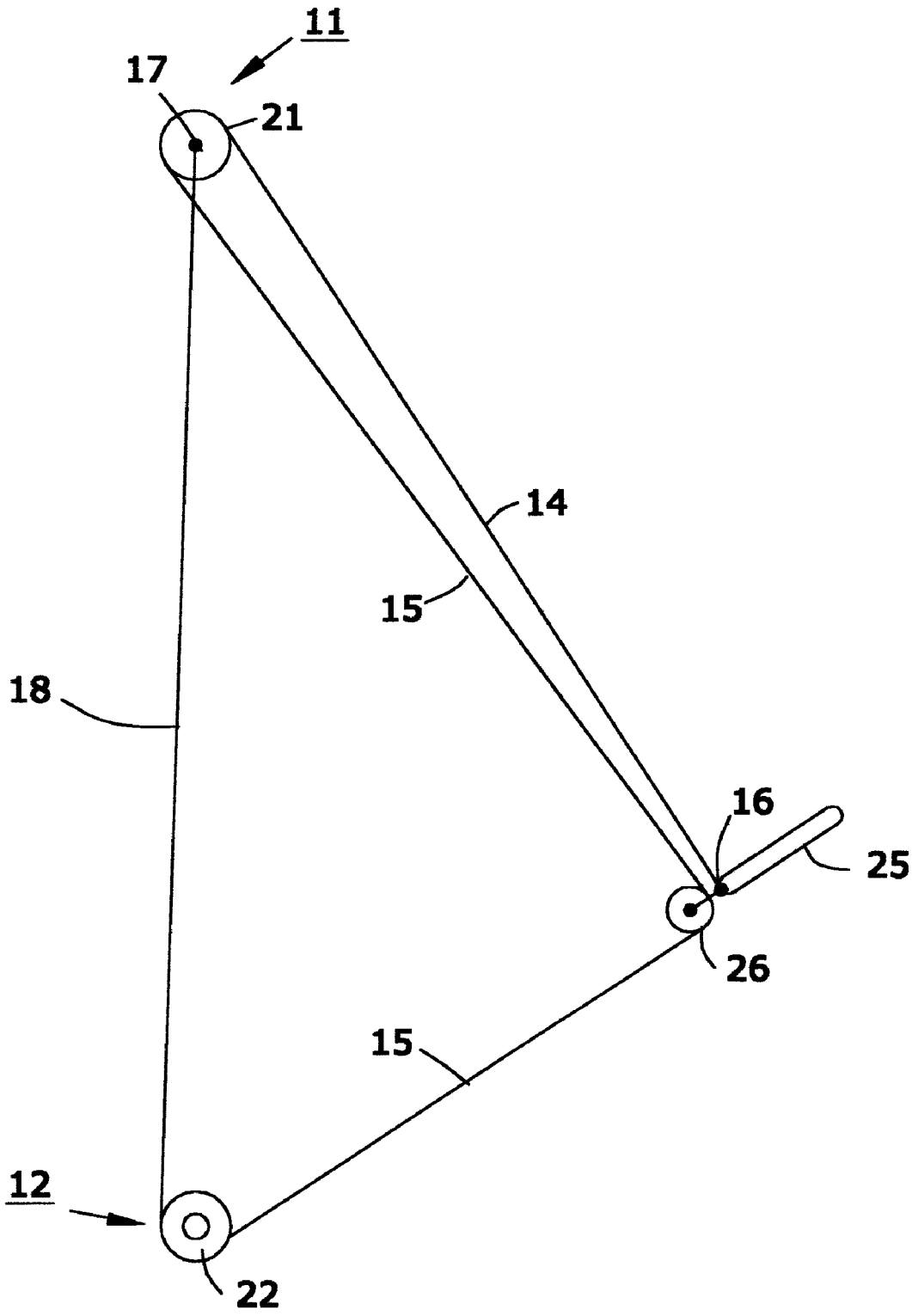

FIG. 6 schematically shows a simpler preferred embodiment using a single fixed pulley 21 in upper resistance region 11 and a single fixed pulley 22 in lower resistance region 12. This embodiment also uses a single resistance cord 18 having one end connected to handle 25 at point 16 to extend as tension cord 14 over upper pulley 21. After rounding upper pulley 21, the elastomeric cord serves as tension element 15 extending from pulley 21 back to pulley 26 on handle 25, down to lower resistance region pulley 22, and back up to fixed end 17 at upper pulley 21. The extension of elastomeric element from pulley 21 over pulley 26 and down to pulley 22 provides the previously described function of tension cord 15, as indicated. Cord 18 provides the elastomeric extent necessary for stretching resistance of cords 14 and 15 to accomplish the previously described resistance functions. The embodiment of FIG. 6 has the advantage of accomplishing all this with a single cord and minimum pulleys.

Figure 7:
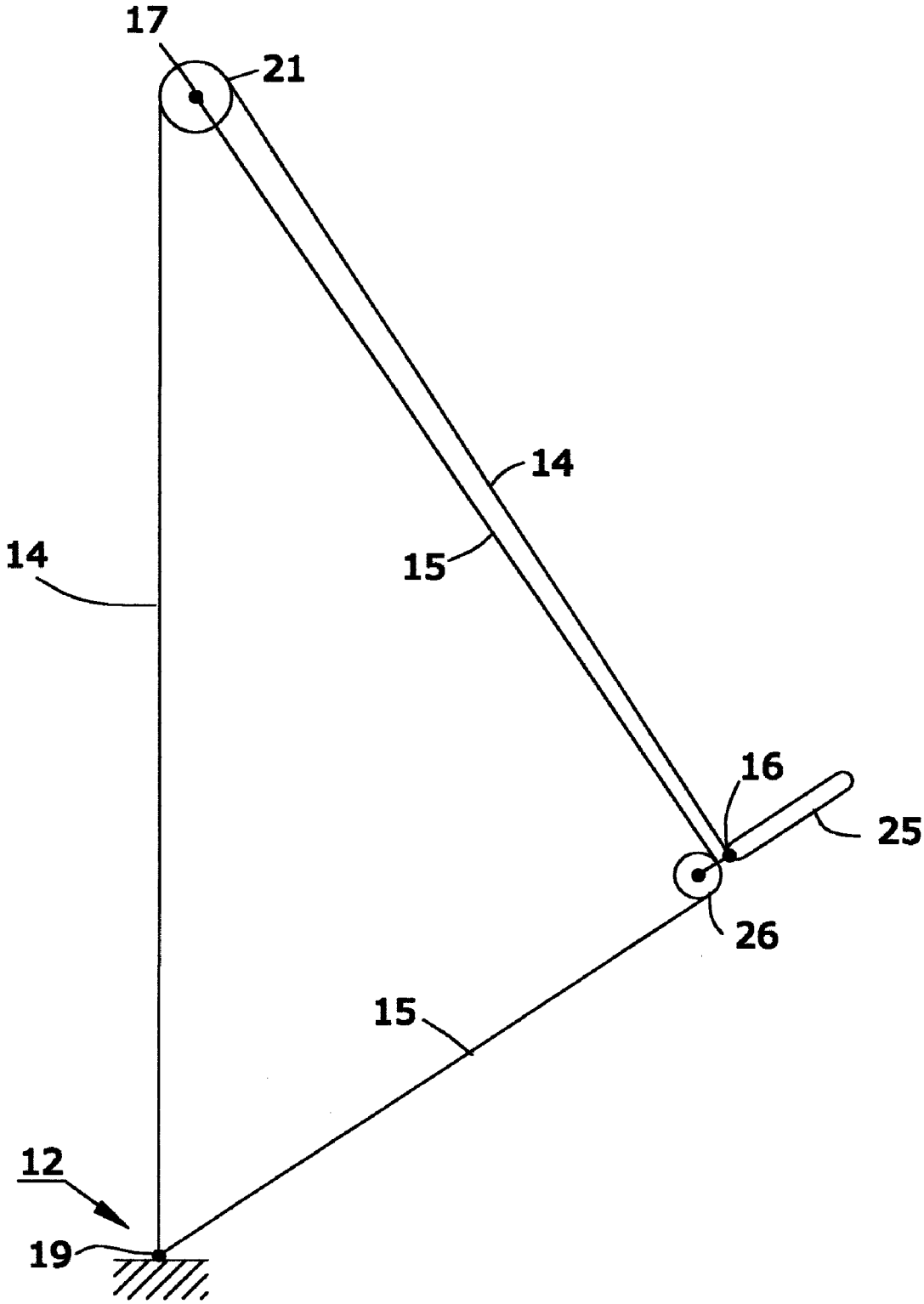

The embodiment of FIG. 7 shows an even further simplification using a single fixed pulley 21 and a moveable pulley 26 on handle 25. An elastomerically stretchable resistance cord 14 extends from one end 16 fastened to handle 25 over pulley 21 and down to a fixed connection 19 at lower resistance region 12. Resistance cord 15 extends from a fixed connection 17 at pulley 21, over pulley 26 and down to the same end connection 19 at lower resistance region 12. This economizes on pulleys, but gives resistance cord 15 a shorter stretchable length that requires selection of suitable elastic material. The functions of cords 14 and 15 remain as previously described for other embodiments.

Figure 8:
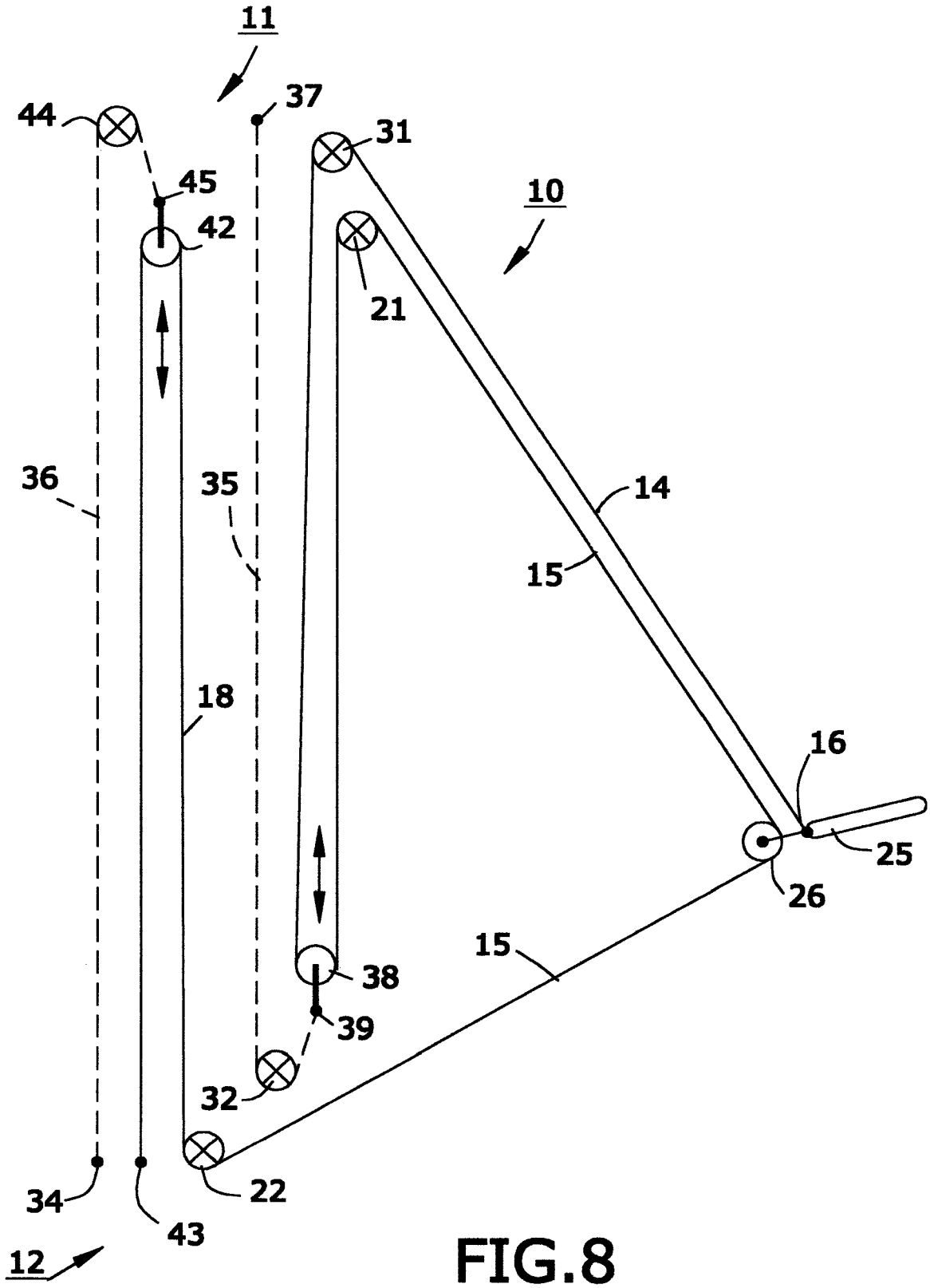

The embodiment of FIG. 8 schematically illustrates the possibility of using a combination of inelastic cords and elastically deformable tension elements. It uses a single cord 18 that is essentially inelastic or not especially stretchable to provide the functions of both cords 14 and 15. Cord 14 extends from one end 16 fastened to handle 25 upward over fixed pulley 31 downward to moveable pulley 38 and back up to fixed pulley 21. From pulley 21 downward over handle pulley 26 and downward to fixed pulley 22 upward to moveable pulley 42 and downward to fixed end 43 serves as tension cord 15. The movement of moveable pulleys 30 and 42 is resisted by respective elastomeric resistance elements 35 and 36. These can be extension springs or elastomeric cords or tubes whose extension provides the necessary resistance for system 10. Elastically deformable element 35, shown in broken lines, extends from a fixed end 37 over fixed pulley 32 and up to an opposite end 39 connected to moveable pulley 38. In a similar way, elastomerically extendable element 36, also shown in broken lines, extends from a fixed end 34 up over a fixed pulley 44 and down to an opposite end 45 connected to moveable pulley 42. Movement of pulleys 38 and 42 are indicated by double headed arrows.

As handle 25 moves through an exercising swing curve, tension elements 14 and 15 follow the handle movement, which necessarily extends elastomeric elements 35 and 36 to provide the necessary swing resistance. Again, this resistance is maximum when handle 25 is moved through a hitting region.

Figure 9:
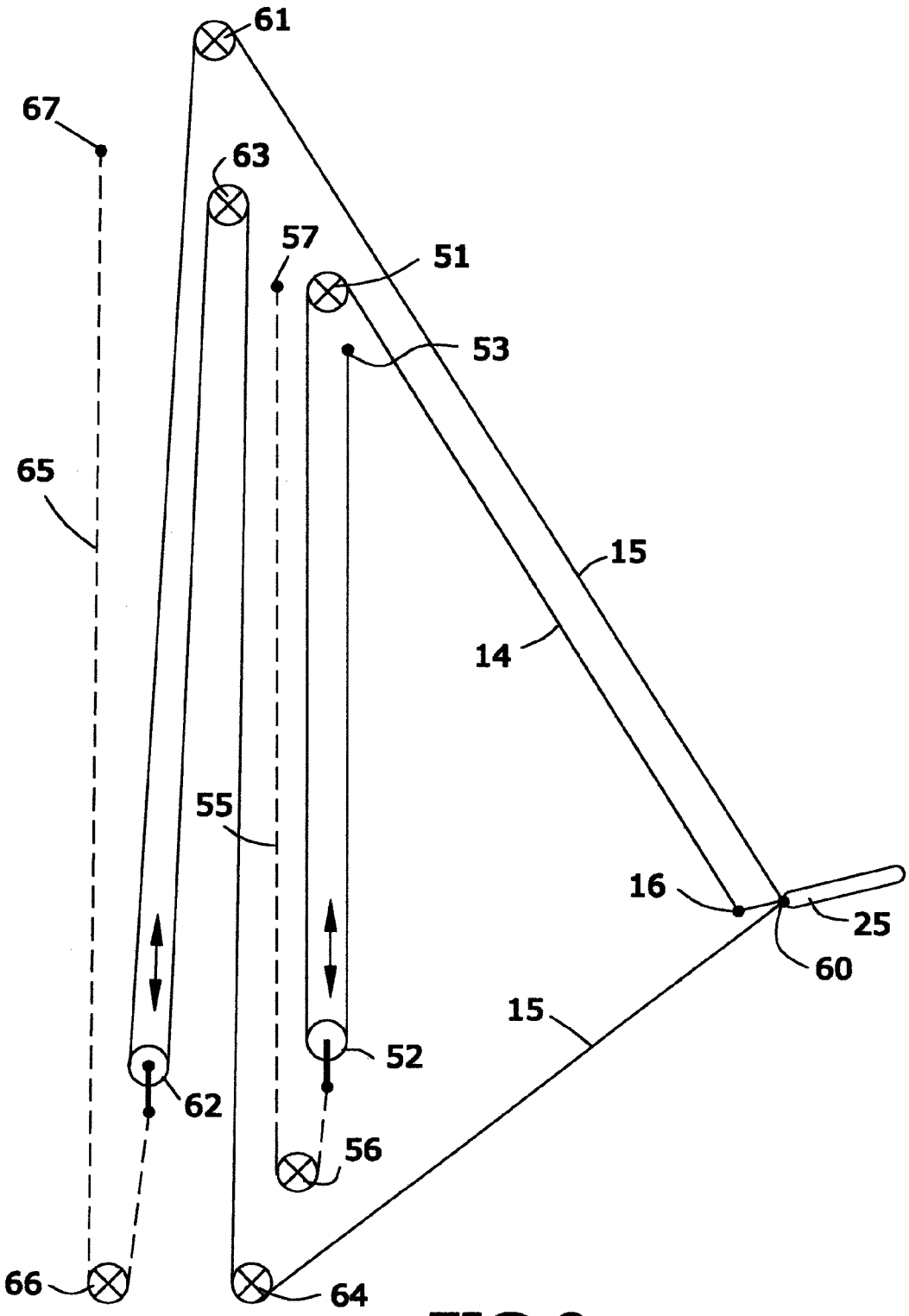

The embodiment of FIG. 9 illustrates another possibility also using a combination of inelastic cords and elastically stretchable cords. It includes exercising handle 25 to which, are connected inelastic cord 14 providing predominantly downward resistance and cord 15 providing predominantly horizontal resistance. Cord 14 extends from one end 16 fastened to handle 25 upward over fixed pulley 51, downward to moveable pulley 52 and back up to fixed end 53. Movement of pulley 52 is resisted by elastically stretchable cord 55 connected to pulley 52 and reeved over fixed pulley 56 and extending up to fixed end 57. As handle 25 moves downward from a back swing or upper tension region in the vacinity of fixed pulley 51, cord 14 pulls upward on moveable pulley 52, which stretches elastic cord 55 to resist such downward movement.

Inelastic cord 15 is formed as a loop having both ends connected to handle 25, preferably at point 60. From there, an upper reach of cord 15 extends over fixed upper pulley 61, down to moveable pulley 62, back up to fixed pulley 63, and down to fixed lower pulley 64, from whence a lower reach of cord 15 extends back to connection 60 at handle 25. As handle 25 moves downward from the back swing region, cord 15 causes a relatively small take up on moveable pulley 62. But as handle 25 moves laterally away from upper and lower tension regions occupied by fixed pulleys 61 and 64, cord 15 takes up further on moveable pulley 62 as handle 25 approaches a hitting region. Elastically stretchable cord 65 resists movement of pulley 62 by extending from fixed end 67 downward over fixed pulley 66 and up to moveable pulley 62.

The arrangement of FIG. 9 provides suitable mechanical advantages and suitable elastic cord resistances to lightly resist downward movement of handle 25 from a back swing region, and to more strongly resist horizontal movement of handle 25 toward a hitting region. This provides suitable working exercise for golf swing muscles.

The illustrated embodiments cover only a small fraction of the variations possible with tension cords 14 and 15 extending between upper and lower resistance regions. Fixed ends of cords can be secured in many different locations, and endless combinations of elastomerically deformable cords and tension elements can be used. Any number of pulleys can be deployed, and these also can be arranged in many different ways. The upper resistance region for the two tension elements need not coincide and can be differently positioned.

All workable embodiments, though, will adhere to the basic principals of providing resistance to downward handle movement from an upper resistance region on a back swing side of the exerciser and a resistance element extending between the upper and a lower resistance region to provide resistance to lateral movement of the handle away from the resistance regions and into the hitting region of the swing curve.

I claim:

1. A method of providing a resistance to an exercising handle moved from a backswing region through a curve to a hitting region to simulate a golf swing, the method comprising:

arranging a first tension element to extend from the handle to an upper pulley arranged at a first resistance region above the shoulders of a person exercising and on a backswing side of the person exercising;

arranging a second tension element to extend between the upper pulley in the first resistance region and a lower pulley in a second resistance region arranged below the hips of the person exercising and on a backswing side of the person exercising;

arranging the second tension element to engage the handle in a region between the upper and lower pulleys:

arranging the first tension element to resist downward movement of the handle from the backswing region to regions below the upper pulley;

arranging the second tension element resist lateral movement of the handle away from both the upper and the lower resistance regions and into the hitting region; and selecting the first and second tension elements to exert a maximum resistance as the handle moves through the hitting region.

2. The method of claim 1 including arranging a pulley on the handle and reeving the second tension element over the handle pulley.

3. The method of claim 1 including using stretchable cord material for the first and second tension elements.

4. The method of claim 1 including extending the first tension element over the upper pulley and on to a fixed termination.

5. The method of claim 1 including forming the second tension element as a closed loop extending between the handle and the upper and lower pulleys.

6. The method of claim 5 including arranging a handle pulley to engage the second tension element.

7. The method of claim 1 including extending the first tension element over the upper pulley to form the second tension element extending from the upper pulley back to a handle pulley, and over the lower pulley and on to a fixed location.

8. A method of arranging a resistance system to resist movement of a handle in a simulated golf swing from a backswing region downward and laterally into a hitting region, the method comprising:

deploying a first tension element to extend from the handle and over an upper pulley mounted at an upper resistance region arranged above the shoulders of a person exercising and on a backswing side of a person exercising;

arranging the first tension element to apply significant resistance to downward movement of the handle and to apply insignificant resistance to lateral movement of the handle into the hitting region;

deploying a second tension element to extend between the upper pulley at the upper resistance region and a lower pulley mounted at a lower resistance region arranged below the hips of the person exercising and on the backswing side of the person exercising;

deploying the second tension element to engage the handle between the upper and lower pulleys;

arranging-the second tension element to apply significant resistance to lateral movement of the handle away from the resistance regions and into the hitting region and to apply insignificant resistance to downward movement of the handle from the backswing region; and arranging the combined resistance of the first and second tension elements to be largest as the handle is moved through the hitting region.

9. The method of claim 8 including providing the handle with a pulley and reeving the second tension element over the handle pulley.

10. The method of claim 8 including using stretchable cord material for the first and second tension elements.

11. The method of claim 8 including deploying the first tension element to extend beyond the upper pulley to a fixed location.

12. The method of claim 8 including deploying the second tension element as a continuous loop extending over the upper and lower pulleys and over a handle pulley.

13. The method of claim 8 including forming the first and second tension elements as different regions of a stretchable cord extending from the handle over the upper pulley, back over a pulley on the handle, to and over the lower pulley and beyond to a fixed location.

14. A method of applying resistance to movement of a handle in a simulated golf swing from a back swing region downward and laterally into a hitting region, the method comprising:

positioning an upper pulley in an upper resistance region above the shoulders of a person exercising and on a backswing side of the person exercising;

positioning a lower pulley at a lower resistance region arranged below the hips of the person exercising and on a backswing side of the person exercising;

deploying a stretchable first tension element to extend from the handle to and over the upper pulley;

deploying a stretchable second tension element to extend between the upper and lower pulleys;

engaging the second tension element with the handle in a region between the upper and lower pulleys; and selecting stretchability and resistance characteristics of the first and second tension elements so that the combined resistance of the first and second tension elements offers less resistance to movement of the handle downward from the backswing region and offers more resistance to movement of the handle laterally away from the upper and lower resistance regions to and through the hitting region.

15. The method of claim 14 including arranging a pulley on the handle to serve as the handle engagement with the second tension element.

16. The method of claim 15 including forming the second tension element as a continuous loop extending between the handle and the upper and lower resistance pulleys.

17. The method of claim 14 including extending the first tension element beyond the upper pulley to a fixed location.

18. The method of claim 14 including using elastically stretchable cords for the first and second tension elements.

* * * * *